United States Patent [19]

Clark et al.

[11] Patent Number: 4,730,659

[45] **Date of Patent: * Mar. 15, 1988**

[54] CASTING APPARATUS

[75] Inventors: Peter J. Clark, Cannock; Anthony W. Hudd; Stephen T. Bloor, both of Sutton Coldfield, all of England; Erling Roller, Essen, Fed. Rep. of Germany

[73] Assignee: IMI Refiners Ltd., Walsall, England

[ * ] Notice: The portion of the term of this patent subsequent to Feb. 3, 2004 has been disclaimed.

[21] Appl. No.: 9,215

[22] Filed: Jan. 30, 1987

Related U.S. Application Data

[63] Continuation of Ser. No. 692,543, Jan. 18, 1985, Pat. No. 4,640,335.

[30] Foreign Application Priority Data

Jan. 25, 1984 [GB] United Kingdom ..... 8401976

[51] Int. Cl.[4] ..... B22D 11/10

[52] U.S. Cl. ..... 164/440

[58] Field of Search ..... 164/440, 490

[56] References Cited

U.S. PATENT DOCUMENTS

| | | |
|---|---|---|
| 2,131,070 | 9/1938 | Poland . |
| 2,983,972 | 5/1961 | Moritz . |
| 3,076,241 | 2/1963 | Simonson et al. . |
| 3,212,142 | 10/1965 | Moritz . |
| 3,363,669 | 1/1968 | Wertli . |
| 3,530,926 | 9/1970 | Wertli . |
| 3,566,954 | 3/1971 | Gamble et al. . |
| 3,568,756 | 3/1971 | Dain . |
| 3,593,778 | 7/1971 | Foye . |
| 3,857,437 | 12/1974 | Watts . |
| 3,905,418 | 9/1975 | Watts . |
| 3,987,840 | 10/1976 | Birat . |
| 4,244,420 | 1/1981 | Dain . |
| 4,368,774 | 1/1983 | Adamec et al. . |

FOREIGN PATENT DOCUMENTS

| | | |
|---|---|---|
| 0049239 | 4/1982 | European Pat. Off. . |
| 1508799 | 9/1971 | Fed. Rep. of Germany . |
| 170578 | 7/1975 | Poland . |
| 1048920 | 11/1966 | United Kingdom . |
| 1173779 | 12/1969 | United Kingdom . |
| 1182263 | 2/1970 | United Kingdom . |
| 1243778 | 8/1971 | United Kingdom . |
| 1307424 | 2/1973 | United Kingdom . |
| 1307423 | 2/1973 | United Kingdom . |
| 1307422 | 2/1973 | United Kingdom . |
| 1312243 | 4/1973 | United Kingdom . |
| 1334276 | 10/1973 | United Kingdom . |
| 1337971 | 11/1973 | United Kingdom . |
| 1430573 | 3/1976 | United Kingdom . |
| 1426866 | 3/1976 | United Kingdom . |
| 2001560 | 2/1979 | United Kingdom . |
| 2003064 | 3/1979 | United Kingdom . |
| 1554717 | 10/1979 | United Kingdom . |
| 1591897 | 7/1981 | United Kingdom . |
| 2079652 | 1/1982 | United Kingdom . |

OTHER PUBLICATIONS

Abstract of U.S.P. 3,857,437 in Official Gazette of Dec. 31, 1974, p. 1943.

*Primary Examiner*—Kuang Y. Lin

*Attorney, Agent, or Firm*—Cushman, Darby & Cushman

[57] ABSTRACT

Horizontal casting apparatus which includes a composite sleeve or ring at the entrance to the mould comprising a graphite inner portion and an insulating outer portion. The apparatus can optionally have an inert gas shield around the composite ring to protect the graphite component thereof against oxidation.

7 Claims, 1 Drawing Figure

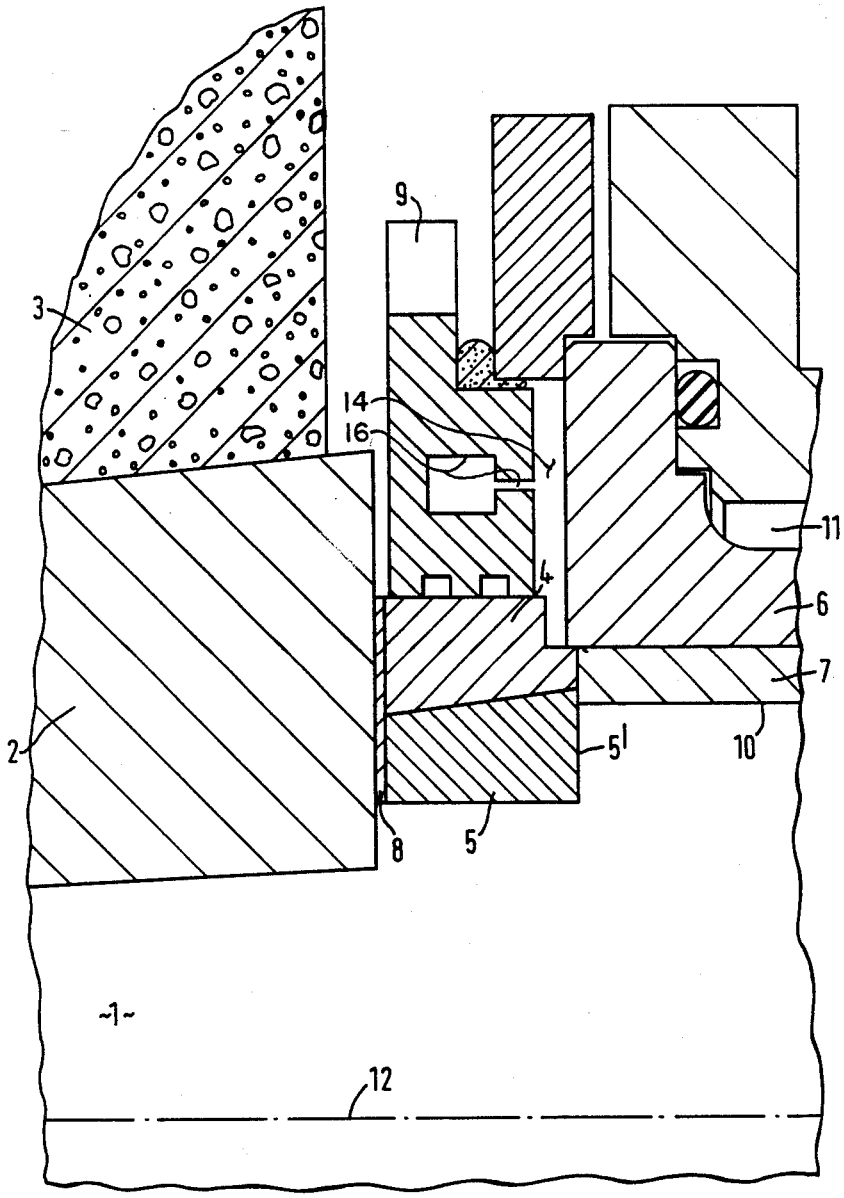
9
3
14
16
11
4
6
7
2
5'
10
8
5
-1-
12

CASTING APPARATUS

This is a continuation of application Ser. No. 692,543, filed Jan. 18, 1985 (now U.S. Pat. No. 4,640,335, issued Feb. 3, 1987).

BACKGROUND OF THE INVENTION

This invention relates to apparatus suitable for use in the continuous casting of metals, especially copper, and more particularly to such apparatus in which the casting occurs in a horizontal plane.

In general, a continuous casting process relates to one in which molten metal stored in a container, usually referred to as a tundish, is allowed to flow at a predetermined rate through a tubular or other cavity in a mould in which solidification of the metal occurs.

In the case of many metals, it is critical that a variety of process parameters are correctly controlled, including the composition and nature of the mould surface on which the metal solidifies, the rate of flow of metal, the temperature at different parts of the casting apparatus and in particular the temperature gradient across critical parts of the apparatus. In the case of copper in particular, there can be problems in achieving the desired properties in the cast metal. It has generally been found that graphite is an excellent mould surface material in that newly solidified metal can slide readily over its surface and not adhere thereto without the need for lubricants. It is also known that casting in a horizontal plane is beneficial in certain respects although this can in itself present problems in controlling the various process parameters.

The present invention is concerned with the provision of novel apparatus for use in the horizontal continuous casting of metals, the use of which generally overcomes problems previously associated with such apparatus.

SUMMARY OF THE INVENTION

In accordance with the invention there is provided apparatus for the continuous casting of metals which includes a horizontally oriented mould, means for cooling the mould, feed means through which molten metal can pass from a container towards the mould, and means intermediate the feed means and the mould comprising a composite sleeve having an inner portion which contacts the metal to be cast and an outer portion which is made from an insulating material, the cross section of the sleeve aperture adjacent the mould entrance being smaller than that of the mould so that the sleeve inner portion forms a shoulder immediately adjacent the mould entrance.

The apparatus of the invention is especially suitable for the continuous casting of copper. It allows for:

(i) The mould and related components to reciprocate to prevent the solidifying metal adhering to the mould surface.

(ii) control of the temperature gradient in the apparatus so that the molten metal is kept sufficiently hot to prevent solidification until it enters the mould but ensures solidification of at least a thin crust or shell on the outer surface of the metal immediately it does enter the mould.

(iii) the provision of a shoulder immediately adjacent the mould entrance substantially next to which the solidifying crust or shell of metal is formed.

(iv) the use of a chosen mould surface material, especially graphite, not only on the surface of the mould itself but also on the surface of the shoulder.

A critical component of the apparatus is the composite sleeve. Typically, although not necessarily, the sleeve will have a circular cross-section and will have a relatively short length and can therefore be regarded as a ring-shaped component. The cross-sectional shape of this sleeve or ring will generally be of the same shape as that of the mould and will in general be fixed in contact with an end of the mould with the respective longitudinal axes parallel and aligned so that the sleeve forms a substantially uniform shoulder around the end of the mould.

Graphite is a preferred material for the mould surface and the same material can usefully be employed for the inner portion of the composite sleeve or ring. The thickness of this inner portion must, however, be sufficiently large to ensure that only the inner portion, and not the outer portion, forms the shoulder. Graphite is not a good insulator and to ensure that the molten metal remains sufficiently hot until it enters the mould, the outer portion of the composite sleeve or ring must be made from a good insulating material having adequate mechanical strength, and, in addition, the inner and outer portion must be held in close contact with each other.

Use of this composite sleeve or ring therefore ensures that a chosen material such as graphite can be used to contact the metal to be cast in the mould itself and in the immediate vicinity of the mould whilst ensuring that the insulating portion of the composite sleeve or ring keeps the metal from solidifying prematurely.

Preferably, the inner portion of the sleeve or ring will be as thin as possible commensurate with its providing the shoulder and maintaining its integrity. Most preferably, to ensure optimum insulation, the cross-section of the inner portion tapers on the side adjacent the insulating outer portion and becomes smaller in a direction away from the shoulder so that the cross-section of the inner portion is, for example, trapezoidal in shape. It has also been found that such a trapezoidal (or similar) shape can be beneficial in ensuring a tight fit or force fit between the two portions of the sleeve or ring which is essential to aid insulation.

The cooling of the mould is by conventional means. Generally the graphite (or whatever) surface lining of the mould is surrounded by a copper (or other conductive metal) jacket around which are channels through which cooling fluid, normally water, passes. The graphite surface is usually tapered to some extent so that the cross section of the mould interior is smaller at the outlet than at the inlet to take account of the contraction of the solidifying metal in the mould.

Graphite is readily oxidisable at the temperatures encountered in the casting process and such oxidation, especially at the critical region of the interface between the composite sleeve and the mould entrance in the vicinity of the shoulder, can detrimentally affect the quality of the metal being cast. In preferred embodiments of the invention, means are therefore provided to protect the composite sleeve or ring and the mould interface surface from the atmosphere. This can be effected by providing a nitrogen or other inert gas shield about the relevant parts of the apparatus; the inert gas can usefully be passed through passageways formed adjacent these parts.

DESCRIPTION OF THE PREFERRED EMBODIMENTS

To illustrate the invention, reference is made by way of example only, to the accompanying drawing which shows part of a casting apparatus of the invention.

With reference to the drawing, the casting apparatus comprises feed means generally designated 1 having an insulating ceramic feed tube 2 and surrounded by refractory concrete 3, a composite circular ring having an outer portion 4 made from an insulating ceramic within which is force-fitted an inner portion 5 made from graphite, and a mould having a copper jacket 6 within which is tightly fitted a mould lining 7 made from graphite.

The tube 2 and the composite ring 4/5 are rigidly held in contact with each other by means not shown and a seal between them is provided by an insulating gasket 8. The ring 4/5 is shrink-fitted within a steel carrier ring 9 and is also rigidly held in contact with the mould and in particular with the graphite mould lining 7 by means not specifically shown. The inner portion 5 thereby forms a shoulder 5' immediately adjacent the mould surface 10. The mould surface 10 tapers so that its cross section is greater at the upstream end. Cooling water passes through channels 11 in those parts of the mould surrounding the copper jacket 6.

Graphite is readily oxidisable at the temperatures encountered in the casting process and such oxidation, especially at the critical region of the interface between the composite sleeve and the mould entrance in the vicinity of the shoulder, can detrimentally affect the quality of the metal being cast. In preferred embodiments of the invention, means are therefore provided to protect the composite sleeve or ring and the mould interface surface from the atmosphere. This can be effected by providing a nitrogen or other inert gas shield 14 about the relevant parts 5, 7 of the apparatus; the inert gas can usefully be passed through passageways 16 formed adjacent these parts.

The whole of the apparatus shown in the drawing can be reciprocated, for example by an amount of 1 to 2 mm, in the direction of the longitudinal axis of the mould i.e. along the centre line 12.

In operation of the apparatus, molten copper is fed from a tundish into the feed tube 2 and hence into the space within the ring 4/5; during this time, the metal remains molten because of the heat insulating properties of the feed tube 2 and the composite ring 4/5. The metal then passes into the mould and the cooled mould surface 10 causes a thin crust or shell of metal to solidify in the vicinity of the shoulder 5'. This shell becomes thicker as it travels along the mould and fully solidified metal is withdrawn from the mould outlet on a continuous basis. The mould taper takes account of the shrinkage of the metal during solidification and cooling and ensures close contact between the metal being cast and the mould surface 10.

We claim:

1. In a mould assembly for the continuous horizontal casting of copper and copper alloys in which there is provided feed means to feed molten metal into a graphite lined horizontally disposed tube which forms the mould, the improvement which comprises:

(i) a composite sleeve sealingly disposed axially between the feed means and the mould, (ii) the composite sleeve comprising a graphite inner ring and an outer ring of thermal insulating material engaged on the inner ring, (iii) the graphite inner ring being in contact with the graphite lining of the tube over part only of the thickness of the graphite lining, and (iv) the graphite inner ring forming a downstream facing annular shoulder at the entrance to the mould.

2. In a mould assembly as claimed in claim 1, the improvement which comprises the sleeve being circular.

3. In a mould assembly as claimed in claim 1, the improvement which comprises a uniform shoulder around the end of the graphite inner ring.

4. In a mould assembly as claimed in claim 1, the improvement which comprises the cross section of the graphite inner ring of the composite sleeve tapering on the side adjacent to the outer ring and becoming smaller in a direction away from the shoulder.

5. In a mould assembly as claimed in claim 4, the improvement which comprises the longitudinal cross-section of sleeve inner ring being of substantially trapezoidal shape.

6. In a mould assembly as claimed in claim 1, the improvement which comprises means to protect the composite sleeve and the interface between the mould and the sleeve from the atmosphere.

7. In a mould assembly as claimed in claim 6, the improvement comprising the means being selected from the group Nitrogen or other inert gas shield about the relevant parts of the apparatus.

* * * * *